US010428572B2

(12) United States Patent
Oster et al.

(10) Patent No.: US 10,428,572 B2
(45) Date of Patent: Oct. 1, 2019

(54) ADJUSTING DEVICE

(71) Applicant: Stabilus GmbH, Koblenz (DE)

(72) Inventors: Peter Oster, Koblenz (DE); Andreas Ritter, Hilgert (DE)

(73) Assignee: Stabilus GMBH, Koblenz (DE)

( * ) Notice: Subject to any disclaimer, the term of this patent is extended or adjusted under 35 U.S.C. 154(b) by 83 days.

(21) Appl. No.: 15/709,576

(22) Filed: Sep. 20, 2017

(65) Prior Publication Data

US 2018/0080271 A1 Mar. 22, 2018

(30) Foreign Application Priority Data

Sep. 22, 2016 (DE) ..... 10 2016 218 226

(51) Int. Cl.
*E05F 15/73* (2015.01)
*E05F 15/614* (2015.01)
(Continued)

(52) U.S. Cl.
CPC ..... *E05F 15/73* (2015.01); *E05F 5/00* (2013.01); *E05F 15/614* (2015.01); *E05F 15/622* (2015.01); *E05Y 2201/21* (2013.01); *E05Y 2201/434* (2013.01); *E05Y 2201/71* (2013.01); *E05Y 2400/202* (2013.01); *E05Y 2400/36* (2013.01); *E05Y 2400/45* (2013.01); *E05Y 2400/52* (2013.01); *E05Y 2400/85* (2013.01); *E05Y 2800/11* (2013.01);
(Continued)

(58) Field of Classification Search
CPC . E05F 15/73; E05F 15/614; E05F 5/00; E05F 15/622; E05Y 2201/71; E05Y 2201/434; E05Y 2201/21; E05Y 2400/202; E05Y 2400/45; E05Y 2400/52; E05Y 2400/85; E05Y 2900/531; E05Y 2900/546; E05Y 2800/113; E05Y 2400/36; E05Y 2800/11; E05Y 2800/114; E05Y 2900/50
See application file for complete search history.

(56) References Cited

U.S. PATENT DOCUMENTS 9,174,517 B2 * 11/2015 Scheuring ..... F16H 25/2015
2015/0283886 A1 10/2015 Nania

FOREIGN PATENT DOCUMENTS

DE 10117933 10/2002
DE 10 2012 024 376 6/2014
(Continued)

OTHER PUBLICATIONS

European Search Report filed in EP 17 19 2072 dated Feb. 13, 2018.
(Continued)

*Primary Examiner* — D Glenn Dayoan
*Assistant Examiner* — Melissa A Black
(74) *Attorney, Agent, or Firm* — Rankin, Hill & Clark LLP

(57) ABSTRACT

An adjusting device for a vehicle part which is movable relative to a body of a vehicle, includes a drive arrangement having a drive unit and a movement state sensor, an adjusting element which is displaceable relative to the drive arrangement via the drive unit and a control unit for controlling the drive unit. The control unit is designed to actuate the drive unit according to an actual movement state. The disclosure also relates to a motor vehicle having a body and a vehicle part movable relative to the body, which part is equipped with an adjusting device.

14 Claims, 4 Drawing Sheets

(51) Int. Cl.
*E05F 5/00* (2017.01)
*E05F 15/622* (2015.01)

(52) U.S. Cl.
CPC .... *E05Y 2800/113* (2013.01); *E05Y 2800/114* (2013.01); *E05Y 2900/50* (2013.01); *E05Y 2900/531* (2013.01); *E05Y 2900/546* (2013.01)

(56) References Cited

FOREIGN PATENT DOCUMENTS

| | | |
|---|---|---|
| WO | 2013/013313 | 1/2013 |
| WO | 2015/186275 | 12/2015 |

OTHER PUBLICATIONS

German Search Report filed in DE 10 2016 218 226.9 dated Apr. 7, 2017.

* cited by examiner

ADJUSTING DEVICE

The invention relates to an adjusting device for a vehicle part which is movable relative to a body of a vehicle, in particular for a vehicle door or a vehicle tailgate, comprising a drive arrangement having a drive unit and at least one movement state sensor for detecting a movement state of the drive unit and for outputting corresponding movement state signals, an adjusting element, which is displaceable relative to the drive arrangement by means of the drive unit, and a control unit, associated with the drive arrangement, for activating and deactivating the drive unit.

Adjusting devices of this type are generally known. They are used for example for automatically opening and closing doors and/or tailgates of motor vehicles, particularly passenger vehicles. To this end, the drive arrangement can be provided, in a manner known per se, with a connecting unit for connecting the drive arrangement to a superordinate assembly of the vehicle, i.e. an assembly which does not form part of the adjusting device, whilst the adjusting element can be provided with a further connecting unit for connecting the adjusting device to a further superordinate assembly of the vehicle, i.e. an assembly which does not form part of the adjusting device. In this case, one superordinate assembly may for example be the body of the vehicle, whilst the other superordinate assembly may be the vehicle part which is moveable relative to the body. This all applies to the adjusting device according to the invention, too.

Although, as mentioned above, the adjusting devices according to the invention can be used for power-assisted opening and closing, and also automatic opening and closing, both of vehicle doors and vehicle tailgates, the adjusting device according to the invention is explained hereinafter predominantly with reference to the opening and closing of doors of motor vehicles for simpler representation.

In the known generic adjusting devices, the door is opened or closed automatically by means of the drive unit after the actuation of a switch provided for this purpose, for example after a pull on the door handle. The movement state sensor is used here to monitor the operation of the adjusting device. If the door is opened or closed manually or the door is additionally moved manually during the automatic opening or closing, this can have adverse effects on the drive unit in known adjusting devices. In particular, this can lead to lasting impairment of the efficiency of the drive unit and, in extreme cases, even damage thereto.

The object of the present invention is to provide a remedy for this.

This object is achieved according to the invention by an adjusting device of the type mentioned at the outset, in which the control unit has a signal input to which the at least one movement state sensor is connected for transmitting the movement state signals to the control unit, and in that the control unit is designed to actuate the drive unit according to the actual movement state if the movement state signals transmitted to the control unit by the movement state sensor indicate an actual movement state of the drive unit which deviates from a target movement state.

An actuation of the drive unit according to its actual movement state here can essentially consist in the drive unit only being actuated if it is no longer force-actuated externally.

This forced actuation is usually the cause of the impairment of the drive unit.

The control unit can advantageously be designed to actuate the drive unit to assist the movement producing the actual movement state if the movement state signals transmitted to the control unit by the movement state sensor indicate an actual movement state of the drive unit which deviates from a target movement state.

The target movement state can be, for example, the rest state, i.e. the deactivated state, of the drive unit. However, if the movement state signals in this state indicate that the drive unit is nevertheless being actuated, the control unit assumes that the vehicle door is being actuated manually and controls the drive unit such that it assists the manual actuation of the door in the manner of power steering. The aim here can advantageously be to also enable the door to be actuated with a low force in the order of magnitude of 5 to 10 N if the vehicle is on an incline or on its side.

The target movement state can, however, also be a predetermined movement state, for example a movement state corresponding to an automatic opening or closing procedure of the door. However, if the movement state signals indicate an actual movement state which deviates from this target movement state, the control unit assumes that the automatic opening or closing is no longer desired and the vehicle door is to be actuated manually. In this case, too, the drive unit provides control to assist the manual actuation of the door in the manner of power steering.

As indicated above, the adjusting device according to the invention can also be designed to open and close the door automatically. The adjusting device here can be designed, for example, to interpret a long pull on the door handle as a request for automated opening and closing, whilst a short pull on the door handle is interpreted as a request for power-assisted opening and closing.

In conjunction with the present invention, it should be taken into account that manual actuations of doors differ in terms of their movement pattern from other types of actuation, for example a gravity-induced actuation of the door, in particular at the start of the movement. For example, manual opening of the door initially involves a strong actuation, a "sharp movement" as it were, whilst a door influenced by gravity is initially only set in motion slowly, a "creeping movement" as it were. For example, the acceleration with which the door is set in motion can therefore be used as a distinguishing criterion. According to the invention, it is therefore proposed that the control unit is designed to actuate the drive unit according to the actual movement state only if a movement pattern of the actual movement state fulfils at least one predetermined condition.

So that it is possible to prevent movements other than manual movements of the door, for example gravity-induced movements, from being detected as an actual movement state, it can additionally or alternatively be provided that a brake device is associated with the drive unit.

If the brake device is a permanently acting brake device, the brake force can be adjusted, for example, so that it is greater than the gravitational force normally acting on the door whilst the vehicle is on a surface of which the inclination does not exceed a predetermined value, for example 15°. The brake force thus exceeds the force exerted on the door by gravity and can bring a gravity-induced movement of the door to a stop or even prevent it in the first place.

The brake device can for example be a friction brake. In particular, the brake device can comprise a brake element which rotates with a driven shaft of the drive unit and a brake element which is arranged in a rotationally fixed manner on the drive arrangement, which brake elements are in mutual frictional engagement. The brake element arranged on the driven shaft for conjoint rotation can, for example, be pressed under spring pre-tension against the brake element rotating with the driven shaft of the drive unit here for the purpose of generating the frictional engagement.

In this connection, it is furthermore advantageous if the action of the brake device, i.e. its brake force, is adjustable. To this end, for example, the spring pre-tension force which acts on the brake element arranged on the drive arrangement for conjoint rotation can be adjustable.

However, it is also essentially conceivable for the brake device to comprise a brake force interruption unit. In the case of a friction brake, this brake force interruption unit can be designed for example to interrupt the frictional engagement of the two brake elements. The brake force interruption unit can advantageously be actuatable by means of the control unit. In particular, the control unit can be designed to actuate the brake force interruption unit to interrupt the brake force upon activation of the drive unit.

A further problem which occurs upon an automatic movement of vehicle parts which are movable relative to a vehicle body consists in that the vehicle part is always moved over a predetermined movement extent, i.e. a predetermined distance, a predetermined pivot angle or the like. This can lead to damage of the vehicle part if an obstacle is present in the movement path. According to a further aspect of the invention, so that this can be prevented, an adjusting device of the type mentioned at the outset is proposed, in which the control unit has a signal input to which at least one obstacle detection sensor, which does not form part of the adjusting device, may be connected for transmitting obstacle detection signals to the control unit, and in that the control unit is designed to deactivate the drive unit if the obstacle detection signals indicate the presence of an obstacle in the movement path of the vehicle part. The obstacle sensor can be for example a radar sensor, an optical sensor, a laser scanner sensor, an ultrasound sensor or a camera.

It is also advantageous for this aspect of the invention, for which independent protection is sought, if the adjusting device has a brake device of the type mentioned above, since this is able to hold the vehicle part reliably in the position assumed upon deactivation of the drive unit.

In a development of the invention, it is proposed that the adjusting element comprises a spindle.

It can furthermore be provided that the driven shaft of the drive unit extends orthogonally to the adjustment direction of the adjusting unit.

A compact arrangement which requires little installation space can be achieved here for example in that the driven shaft of the drive unit supports a worm gear, wherein the worm gear preferably meshes with a gear wheel which radially inwardly has or supports a spindle nut which is in threaded engagement with a thread of the spindle. In this case, it is merely necessary to ensure axial support of the gear wheel with respect to the adjusting device of the adjusting unit. However, this can be provided in a simple manner by the housing of the drive arrangement.

Finally, the invention also further relates to a motor vehicle having a body and a vehicle part movable relative to the body, which is equipped with an adjusting device according to the invention. It is particularly advantageous that, in this motor vehicle, the vehicle part which is movable relative to the body of the vehicle can be free of any check strap designed with preferred positions. This has advantages not only with regard to the required installation space, but also in terms of the manufacturing costs.

The invention is explained in more detail below on the basis of an embodiment with reference to the accompanying drawings, in which.

Figure 1:
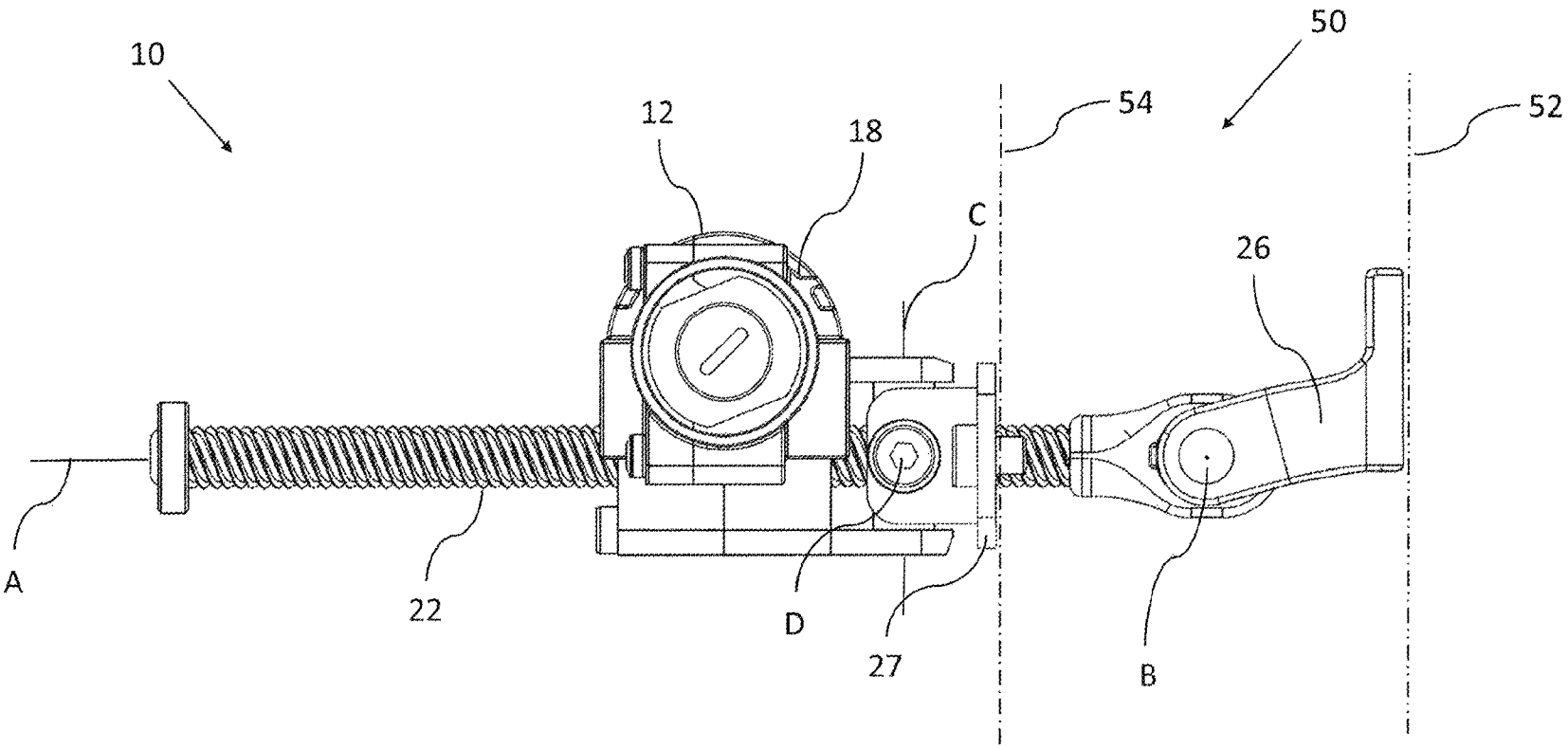
FIG. 1 is a side view of an adjusting device according to the invention.

In FIG. 1, an adjusting device according to the invention is denoted generally by reference sign 10. It serves to move a vehicle part 52, for example a vehicle door or a vehicle tailgate (indicated by a dash-dot-dot line in FIG. 1) of a motor vehicle 50, for example a passenger vehicle, relative to the body 54 (indicated by a dash-dot line in FIG. 1) of the motor vehicle 50. The adjusting device 10 comprises a drive arrangement 12 having a drive unit 14, for example an electric motor, and a movement state sensor 16, for example a Hall sensor, for detecting the movement state of the drive unit 14. The drive unit 14 and the movement state sensor 16 are received in a common housing 18. A brake device 20 (see FIG. 3) is moreover arranged in the housing 18 and is able to brake a movement, in particular a rotation, of the drive unit 14.

The adjusting device 10 furthermore comprises an adjusting element 22 which is formed as a spindle in the embodiment shown.

Figure 2:
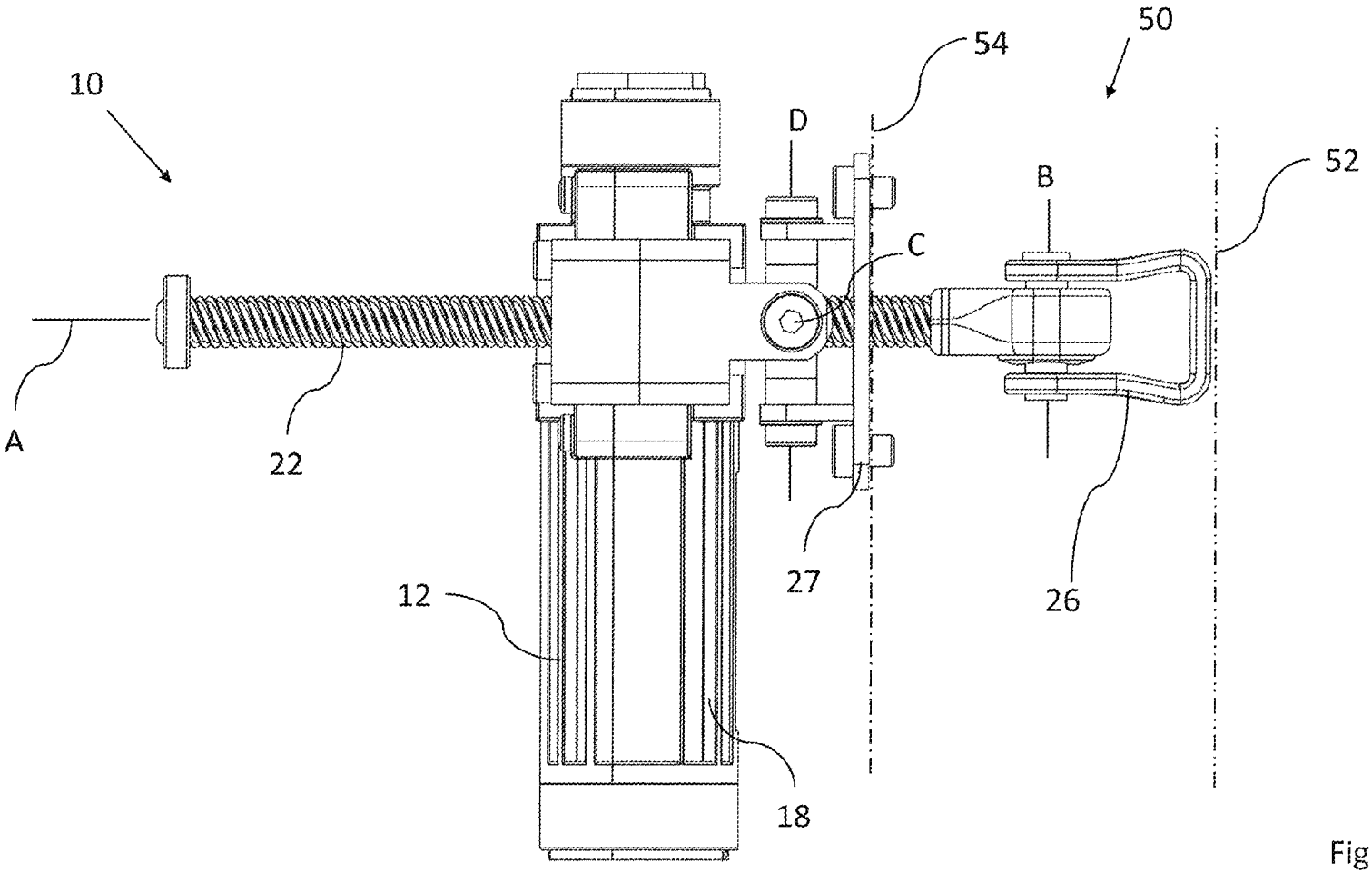
FIG. 2 is a further side view of the adjusting device according to FIG. 1 from the direction indicated by the arrow II in FIG. 1.

The adjusting element 22 is articulated to the movable vehicle part 52 by means of a mount 26, whilst the drive arrangement 12 is connected to the body 54 of the vehicle 50 via a cardanic suspension 27. The degrees of freedom of movement provided by the cardanic suspension 27, namely its slewability about the axes C and D (see FIG. 2), the pivotability of the mount 26 about the axis B and the rotatability of the spindle 22 relative to the drive arrangement 12 about the axis A reliably prevent the adjusting device 10 from tilting.

Figure 3:
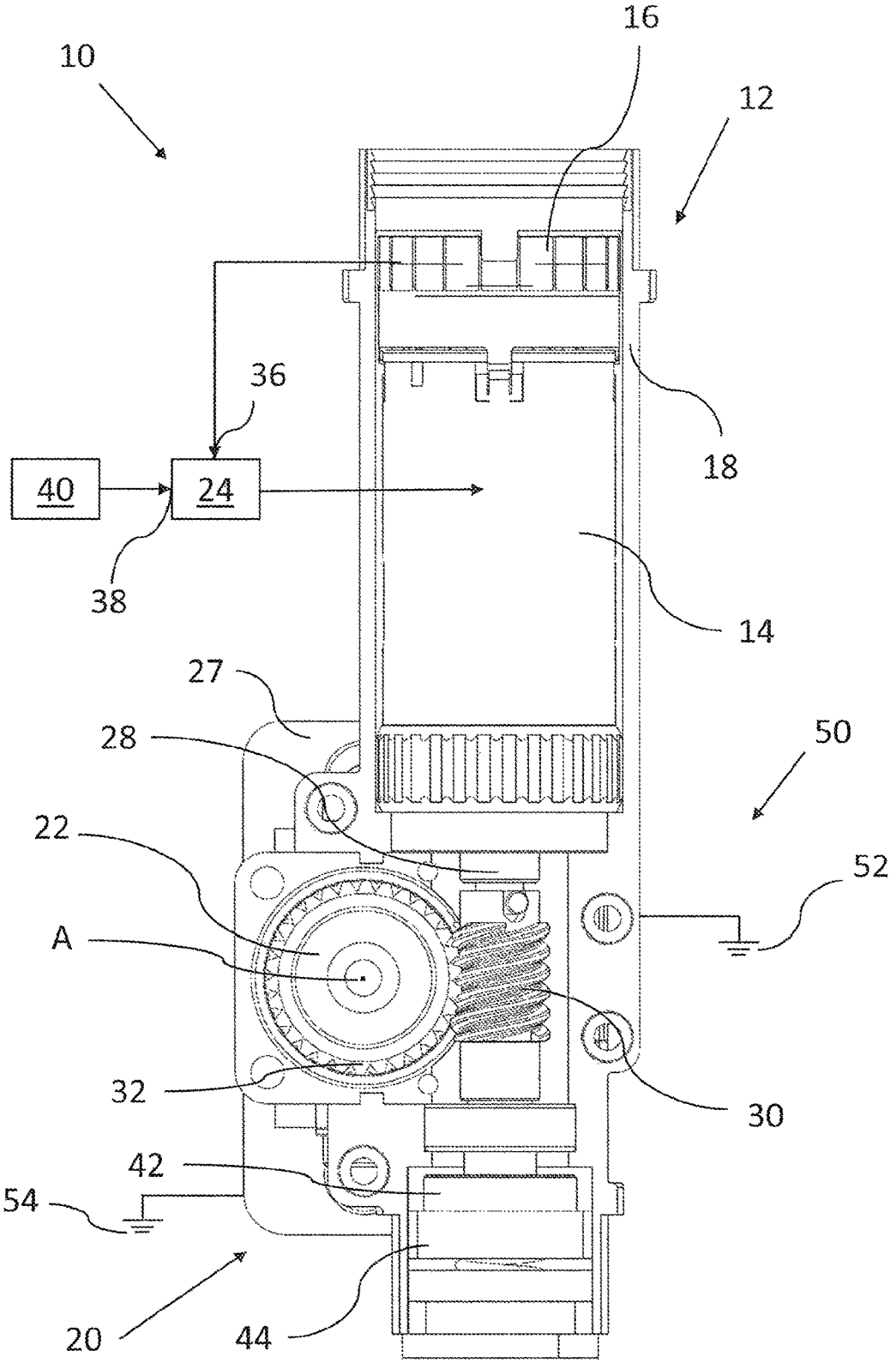
FIG. 3 is a partially open side view of the adjusting device from FIGS. 1 and 2.
Figure 4:
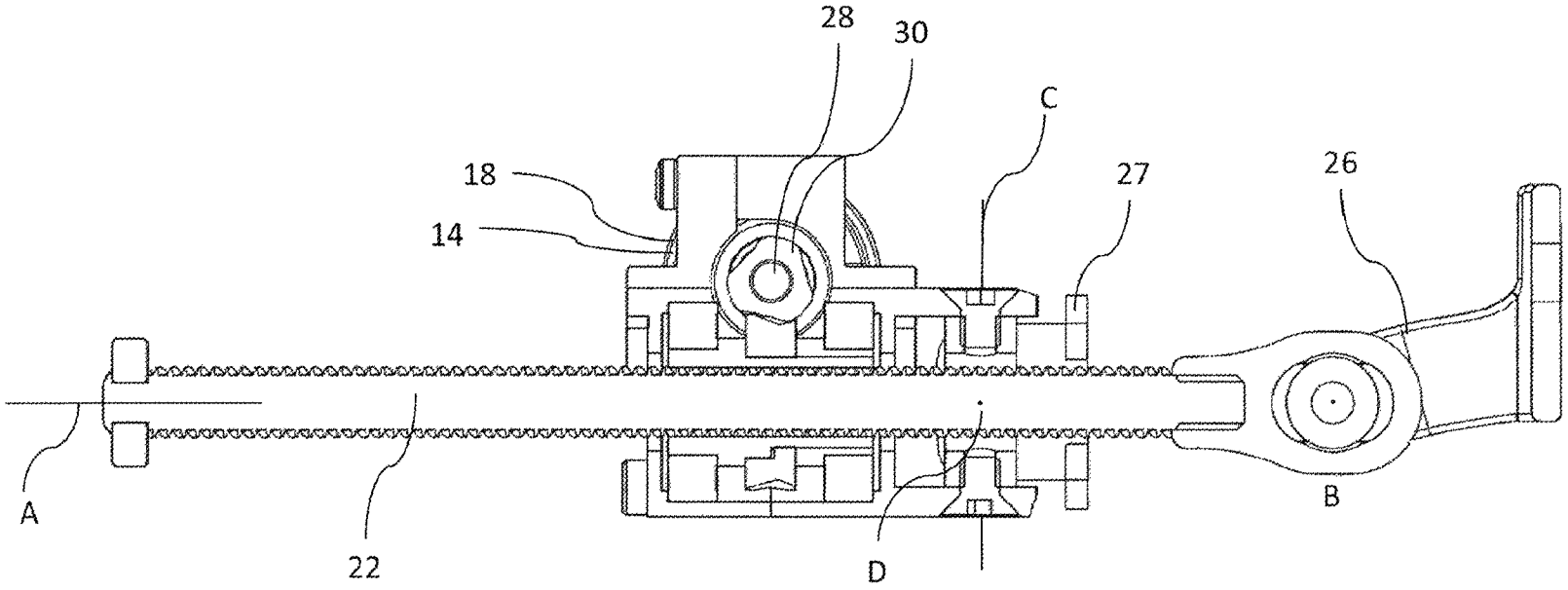
FIG. 4 is a section through the view shown in FIG. 1.

As can be seen in particular in FIGS. 3 and 4, a driven shaft 28 of the drive unit 14 supports a worm gear 30 which meshes with a gear wheel 32 which surrounds the spindle 22. Radially inwardly, the gear wheel 32 is connected to a spindle nut 34 which is in threaded engagement with a thread of the spindle 22. A rotational movement of the drive unit 14 is thus converted into a linear movement of the spindle 22 in the direction A of it is longitudinal extent.

According to FIG. 3, the brake device 20 is also associated with the driven shaft 28 of the drive unit 14. In the embodiment shown, it is designed as a permanently acting friction brake. To this end, it comprises a brake element 42, which is connected to the driven shaft 28 for conjoint operation, i.e. it rotates with the driven shaft 28, and a brake element 44 which is connected in an operationally fixed manner to the housing 18, i.e. it is arranged in a rotationally fixed manner. The brake element 4 arranged in a rotationally fixed manner and the rotating brake element 42 are in mutual frictional engagement, wherein this frictional engagement is permanently maintained by a spring (not shown). The brake force generated by this permanent frictional engagement is preferably selected such that the movable vehicle part 52 is not able to start moving automatically whilst the vehicle 50 is on a surface of which the angle of inclination is, for example, a maximum of 15° to the horizontal depending on the design of the brake device 20. The movable vehicle part 52 can thus be held in any intermediate position along its adjustment path.

To control the operation of the drive unit 14, a control unit 24 (shown merely schematically in FIG. 3) is furthermore associated with the drive arrangement 12. Output signals of the movement state sensor 16 can be supplied to the control unit 24 via a signal input 36. The output signals of an obstacle detection sensor 40 can furthermore be supplied to the control unit 24 via a signal input 38.

If, on the basis of the signals of the movement state sensor 16, the control unit 24 establishes that the movable vehicle part 52 is being moved manually, it controls the drive unit 14 to assist the desired movement, i.e. in the manner of power steering. That proportion of the force required to move the movable vehicle part 52 which is taken over by the drive unit 14 here can be adjusted as required, although it is advantageously selected such that the vehicle part 52 can be actuated with a low force in the order of magnitude of 5 to 10 N, even if the vehicle 50 is on a slope or on its side.

If the control unit 24 does not establish any request for a manual actuation of the movable vehicle part 52, but a command is issued to move the movable vehicle part 52 automatically, the control unit 24 takes into account the obstacle detection signals supplied thereto by the obstacle detection sensor 40 when executing this command. If the control unit 24 establishes that there is an obstacle in the movement path of the movable vehicle part 52, it deactivates the drive unit 14 so that the movable vehicle part 52 comes to a stop before the obstacle, without colliding therewith and being damaged thereby.

It should be added that, for better signal resolution, it is conceivable to provide a second movement state sensor (not shown) on the driven side, i.e. for example on the worm gear 30 or on the spindle 22.

The invention claimed is:

1. Adjusting device for a vehicle part which is movable relative to a body of a vehicle, in particular a vehicle door or a vehicle tailgate, comprising:

a drive arrangement
having a drive unit and
at least one movement state sensor for detecting a movement state of the drive unit and for outputting corresponding movement state signals, an adjusting element, which is displaceable relative to the drive arrangement via the drive unit, and a control unit, associated with the drive arrangement, for activating and deactivating the drive unit,
wherein the control unit has a signal input to which the at least one movement state sensor is connected for transmitting the movement state signals to the control unit, and in that the control unit is configured to actuate the drive unit according to the actual movement state if the movement state signals transmitted to the control unit by the movement state sensor indicate an actual movement state of the drive unit which deviates from a target movement state,
wherein the control unit is further configured to distinguish a movement pattern of a manual actuation of the vehicle part which is movable relative to the body of the vehicle from a movement pattern of a gravity-induced actuation of the vehicle part which is movable relative to the body of the vehicle, wherein as a distinguishing criterion an acceleration is used, with which the vehicle part which is movable relative to the body of the vehicle is set in motion, and
wherein the control unit is further configured to only actuate the drive unit according to the actual movement state if a movement pattern of the actual movement state fulfils at least one predetermined condition with regard to the acceleration, which indicates the manual actuation of the vehicle part which is movable relative to the body of the vehicle.

2. Adjusting device according to claim 1, wherein the control unit is designed to actuate the drive unit to assist the movement producing the actual movement state if the movement state signals transmitted to the control unit by the movement state sensor indicate an actual movement state of the drive unit which deviates from a target movement state.

3. Adjusting device according to claim 1, wherein a brake device is associated with the drive unit.

4. Adjusting device according to claim 3, wherein the brake device is a permanently acting brake device.

5. Adjusting device according to claim 3, wherein the brake device comprises a first brake element which rotates with a driven shaft of the drive unit and a second brake element which is arranged in a rotationally fixed manner on the drive arrangement, which first and second brake elements are in mutual frictional engagement.

6. Adjusting device according to claim 3, wherein the brake device comprises a brake force interruption unit.

7. Adjusting device according to claim 6, wherein the control unit is designed to actuate the brake force interruption unit to interrupt the brake force upon activation of the drive unit.

8. Adjusting device according to claim 1, wherein the control unit has a signal input to which at least one obstacle detection sensor, which does not form part of the adjusting device, may be connected for transmitting obstacle detection signals to the control unit, and in that the control unit is designed to deactivate the drive unit if the obstacle detection signals indicate the presence of an obstacle in the movement path of the vehicle part.

9. Adjusting device according to claim 1, wherein the adjusting element comprises a spindle.

10. Adjusting device according to claim 1, wherein a driven shaft of the drive unit extends orthogonally to the adjustment direction of the adjusting element.

11. Adjusting device according to claim 1, wherein a driven shaft of the drive unit supports a worm gear, the worm gear meshing with a gear wheel which radially inwardly has a spindle nut which is in threaded engagement with a thread of the adjusting element.

12. Adjusting device according to claim 1, wherein the drive arrangement is provided with a connecting unit for connecting the drive arrangement to a superordinate assembly of the vehicle which does not form part of the adjusting device, whilst the adjusting element is provided with a further connecting unit for connecting the adjusting element to a further superordinate assembly of the vehicle which also does not form part of the adjusting device.

13. Motor vehicle having a body and a vehicle part movable relative to the body, which is equipped with an adjusting device according to claim 1.

14. Motor vehicle according to claim 13, wherein the vehicle part which is movable relative to the body of the vehicle is free of any check strap designed with preferred positions.

* * * * *